US009657459B2

(12) United States Patent
Ogura et al.

(10) Patent No.: US 9,657,459 B2
(45) Date of Patent: May 23, 2017

(54) CONSTRUCTION MACHINE

(71) Applicant: KOBELCO CONSTRUCTION MACHINERY CO., LTD., Hiroshima-shi (JP)

(72) Inventors: Yuto Ogura, Hiroshima (JP); Masakazu Ozaki, Hiroshima (JP); Takeshi Kashiwabara, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 29 days.

(21) Appl. No.: 14/937,049

(22) Filed: Nov. 10, 2015

(65) Prior Publication Data

US 2016/0138243 A1 May 19, 2016

(30) Foreign Application Priority Data

Nov. 17, 2014 (JP) ..... 2014-232991

(51) Int. Cl.
*F01N 13/18* (2010.01)
*E02F 9/08* (2006.01)
*F01N 3/20* (2006.01)

(52) U.S. Cl.
CPC ..... *E02F 9/0866* (2013.01); *F01N 3/2066* (2013.01); *F01N 13/18* (2013.01)

(58) Field of Classification Search
None
See application file for complete search history.

(56) References Cited

U.S. PATENT DOCUMENTS

2010/0192551 A1 8/2010 Yokota
2012/0247861 A1 10/2012 Mizuno et al.
(Continued)

FOREIGN PATENT DOCUMENTS

DE 11 2012 002 667 T5 8/2014
EP 2 194 194 A1 6/2010
(Continued)

OTHER PUBLICATIONS

Extended European Search Report issued on May 3, 2016 in Patent Application No. 15194569.8.

*Primary Examiner* — John Walters
*Assistant Examiner* — Hilary L Johns
(74) *Attorney, Agent, or Firm* — Oblon, McClelland, Maier & Neustadt, L.L.P.

(57) ABSTRACT

Provided is a construction machine which is capable of stably support an exhaust aftertreatment device comprising a first treatment section and a second treatment section arranged in one-above-the-other and side-by-side relation. A hydraulic excavator comprises: an exhaust aftertreatment device comprising a first treatment section and a second treatment section which are arranged in one-above-the-other and in side-by-side relation; a lower plate attached to a lower surface of the exhaust aftertreatment device, and provided above a slewing frame to support the exhaust aftertreatment device from therebeneath in such a manner that the exhaust aftertreatment device is disposed at a position overlapping the engine in side view; and a left vertical plate disposed to extend upwardly from a portion of the lower plate located between the exhaust aftertreatment device and the engine, and attached to a lateral surface of the exhaust aftertreatment device.

9 Claims, 8 Drawing Sheets

(56) References Cited

U.S. PATENT DOCUMENTS

| | | | |
|---|---|---|---|
| 2013/0213726 | A1 | 8/2013 | Okada |
| 2015/0198086 | A1 | 7/2015 | Fukuyoshi et al. |

FOREIGN PATENT DOCUMENTS

| | | | | |
|---|---|---|---|---|
| EP | 2 728 075 | A1 | | 5/2014 |
| JP | 2001271375 | A | * | 10/2001 |
| JP | 2009-079422 | | | 4/2009 |
| JP | 2012-097413 | | | 5/2012 |
| JP | 5205551 | | | 6/2013 |
| JP | 5386434 | | | 1/2014 |
| JP | 2014-025404 | | | 2/2014 |

* cited by examiner

CONSTRUCTION MACHINE

TECHNICAL FIELD

The present invention relates to a construction machine equipped with an exhaust aftertreatment device for purifying exhaust gas of an engine.

BACKGROUND ART

Heretofore, there has been known an exhaust aftertreatment device comprising a first treatment section capable of removing a first component contained in exhaust gas of an engine and a second treatment section capable of removing a second component contained in the exhaust gas.

For example, an exhaust aftertreatment device described in JP 2009-79422A (hereinafter referred to as "Patent Literature 1") comprises: a first treatment section having a filter (Diesel Particulate Filter) for trapping particulate matter (hereinafter referred to as "PM") as one example of the first component; and a second treatment section having a catalyst for promoting a selective catalytic reduction (hereinafter referred to as "SCR") reaction of nitrogen oxides (hereinafter referred to as "NOx") as one example of the second component.

A construction machine described in the Patent Literature 1 further comprises a frame, and an engine provided on the frame. The first treatment section and the second treatment section are arranged side-by-side laterally (in a right-left direction) on the frame.

Meanwhile, in recent years, there has been growing demand for expanding the range of application of an exhaust aftertreatment device to smaller construction machines. In this regard, a small-sized construction machine has serious restriction in terms of space on the frame, so that it is difficult to ensure, on the frame, a space for arranging the first treatment section and the second treatment section in laterally side-by-side relation as in the exhaust aftertreatment device described in Patent Literature 1.

As measures to cope with this situation, it is conceivable to arrange the first treatment section and the second treatment section in one-above-the-other and side-by-side relation (side-by-side in an up-down direction). In this case, however, a gravity center of the exhaust aftertreatment device is shifted to a higher position, as compared to the case where the first treatment section and the second treatment section are arranged in laterally side-by-side relation. This causes difficulty in stably supporting the exhaust aftertreatment device on the frame.

SUMMARY OF INVENTION

It is an object of the present invention to provide a construction machine capable of stably supporting an exhaust aftertreatment device comprising a first treatment section and a second treatment section which are arranged in one-above-the-other and side-by-side relation.

In order to solve the above problem, the inventors of this application have conceived an inventive idea of supporting an exhaust aftertreatment device from therebeneath and a lateral side thereof by a lower member attached to a lower surface of the exhaust aftertreatment device and a vertical member extending upwardly from the lower member.

However, for maintenance of the exhaust aftertreatment device, it is necessary to access each of the first and second treatment sections from a lateral side thereof. Thus, depending on the arrangement of the vertical member, there is a problem of causing deterioration in maintainability of the exhaust aftertreatment device.

Therefore, the present invention provides a construction machine capable of maintaining maintainability of the exhaust aftertreatment device while stably supporting an exhaust aftertreatment device.

Specifically, the present invention provides a construction machine which comprises: a frame; an engine provided on the frame; an exhaust aftertreatment device for purifying exhaust gas of the engine, wherein the exhaust aftertreatment device comprises a first treatment section capable of removing a first component contained in the exhaust gas, and a second treatment section capable of removing a second component contained in the exhaust gas, wherein the second treatment section is disposed above or below the first treatment section in side-by-side relation; a lower member attached to a lower surface of the exhaust aftertreatment device, and provided above the frame to support the exhaust aftertreatment device from therebeneath in such a manner that the exhaust aftertreatment device is disposed at a position overlapping the engine in side view; and a vertical member disposed to extend upwardly from a portion of the lower member located between the exhaust aftertreatment device and the engine, and attached to a lateral surface of the exhaust aftertreatment device.

The present invention can stably support the exhaust aftertreatment device comprising the first treatment section and the second treatment section which are arranged in one-above-the-other and side-by-side relation.

DESCRIPTION OF EMBODIMENTS

With reference to the accompanying drawings, the present invention will now be described based on an embodiment thereof. It should be understood that the following embodiments are presented as some preferred examples obtainable by embodying the present invention, and not intended to limit the technical scope of the present invention.

First Embodiment

FIGS. 1 to 8

Figure 1:
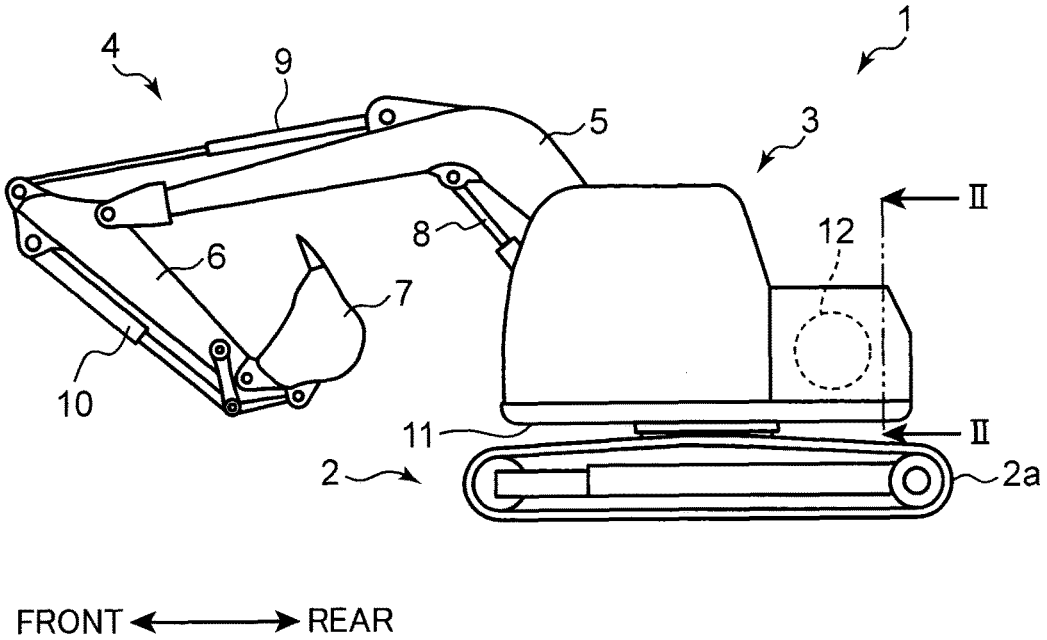
FIG. 1 is a side view illustrating an overall structure of a hydraulic excavator according to a first embodiment of the present invention.

Referring to FIG. 1, a hydraulic excavator 1 as one example of a construction machine according to a first embodiment of the present invention comprises: a lower traveling body 2 provided with a crawler 2*a*; an upper slewing body 3 slewably provided on the lower traveling body 2; and an attachment 4 displaceably attached to the upper slewing body 3.

The attachment 4 comprises: a boom 5 having a base end attached to the upper slewing body 3 rotatably about a horizontal axis upwardly and downwardly; an arm 6 having a base end attached to a distal end of the boom 5 rotatably about a horizontal axis upwardly and downwardly; and a bucket 7 attached to a distal end of the arm 6 rotatably about a horizontal axis.

The attachment 4 also comprises: a boom cylinder 8 operable to rotatably drive the boom 5 with respect to the upper slewing body 3; an arm cylinder 9 operable to rotatably drive the arm 6 with respect to the boom 5; and a bucket cylinder 10 operable to rotatably drive the bucket 7 with respect to the arm 6.

Figure 2:
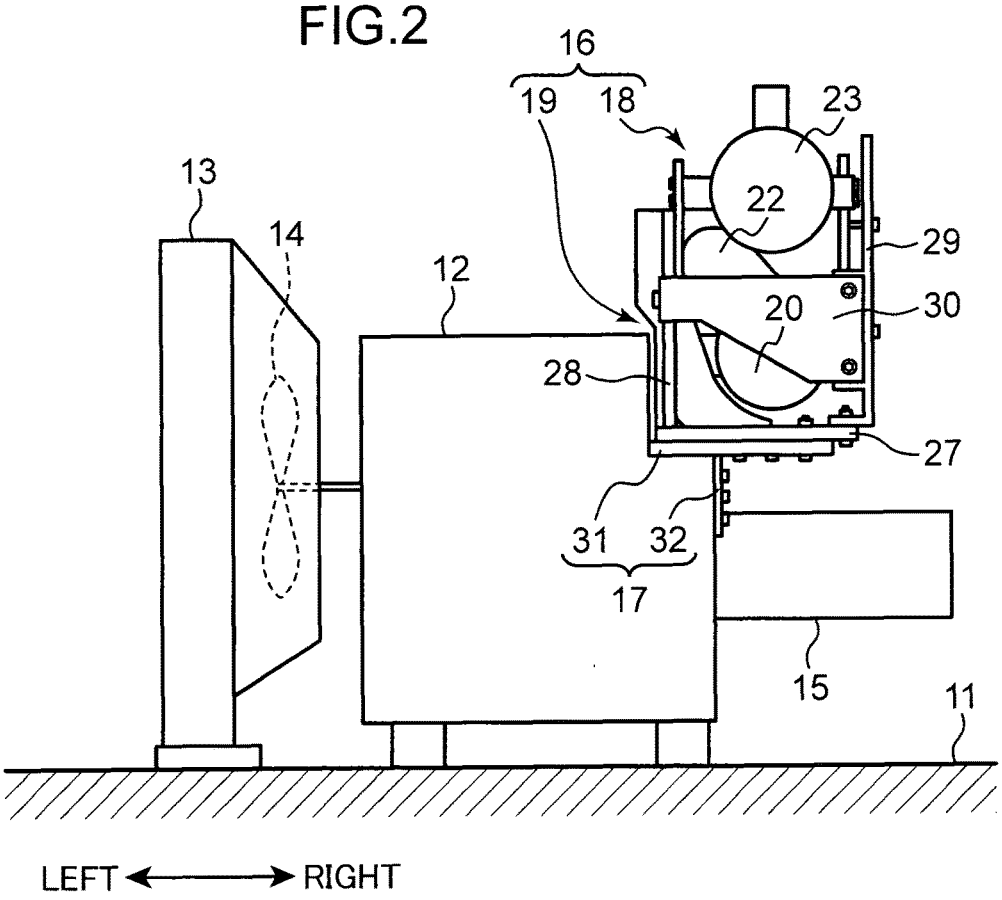
FIG. 2 is a sectional view taken along the line II-II in FIG. 1.

Referring to FIGS. 1 and 2, the upper slewing body 3 comprises: a slewing frame (frame) 11 slewably provided on the lower traveling body 2; and an engine 12, a radiator 13, a cooling fan 14, a hydraulic pump 15, an aftertreatment unit 16 and a holding mechanism 17 each provided on the slewing frame 11. The following description will be made using directions (illustrated directions) on the basis of an operator seated in an operator's seat of a cab (its reference sign is omitted) provided on the upper slewing body 3.

The engine 12 has an output shaft (its reference sign is omitted). The engine 12 is provided on the slewing frame 11 in such a manner that the output shaft is disposed to extend along a right-left (lateral) direction.

The cooling fan 14 is connected to a left end of the output shaft (its reference sign is omitted) of the engine 12, so that it can be rotated according to rotation of the output shaft.

The radiator 13 is provided on a left side of the cooling fan 14, so that it can be cooled by outside air introduced by an action of the cooling fan 14.

The hydraulic pump 15 is connected to a right end of the output shaft (its reference sign is omitted) of the engine 12, so that it can discharge hydraulic oil according to rotation of the output shaft.

Figure 6:
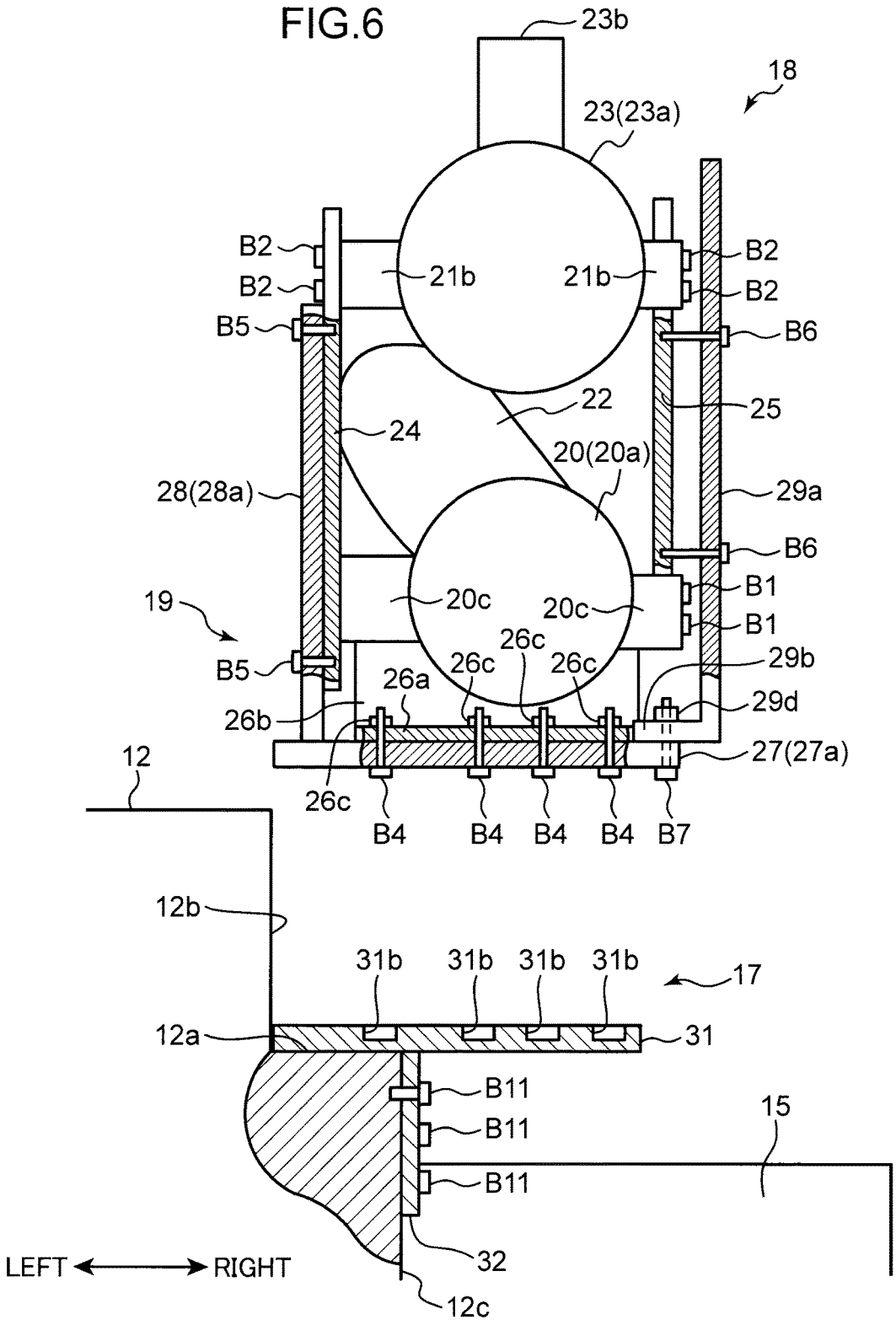
FIG. 6 is a schematic diagram illustrating the aftertreatment unit and a holding mechanism in FIG. 2 in an exploded manner.
Figure 7:
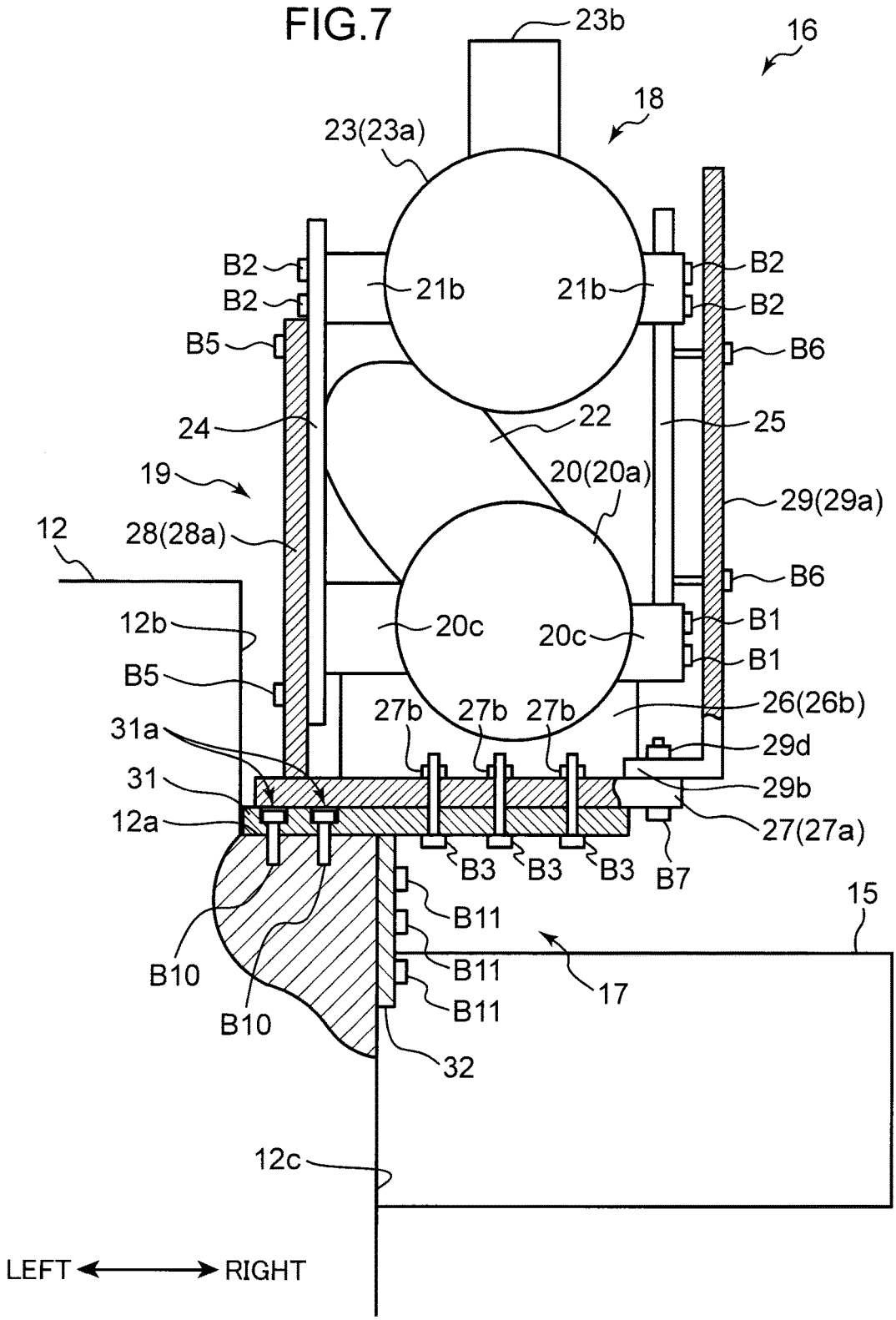
FIG. 7 is a schematic diagram illustrating the aftertreatment unit assembled to the holding mechanism in FIG. 2, wherein a part of the aftertreatment unit is omitted.

The aftertreatment unit 16 is attached to the engine 12 through the holding mechanism 17. With reference to FIGS. 6 and 7, respective structures of the holding mechanism 17 and the engine 12 to which the holding mechanism 17 is attached will be first described.

The engine 12 has: a lower right lateral surface 12*c* to which the hydraulic pump 15 is attached; a mount surface 12*a* extending from an upper edge of the lower right lateral surface 12*c* approximately horizontally and leftwardly; and an upper right lateral surface 12*b* extending upwardly from a left edge of the mount surface 12*a*.

The holding mechanism 17 comprises a loading plate portion portion 31 placed on the mount surface 12*a*, and an attaching plate portion 32 extending downwardly from the loading plate portion 31. The loading plate portion 31 has a portion superposed on the mount surface 12*a* of the engine 12, and a portion located at a lateral position of the mount surface 12*a*. The portion of the loading plate portion 31 superposed on the mount surface 12*a* is attached to the mount surface 12*a* (engine 12) from an upper side thereof by a bolt 10, as illustrated in FIG. 7. In this case, a head of the bolt B10 is disposed within a counterbore 31*a* formed in the loading plate portion 31. On the other hand, the attaching plate portion 32 is attached to the lower right lateral surface 12*c* (engine 12) from a right side thereof by a bolt 11, as illustrated in FIG. 6.

Referring to FIG. 2, the aftertreatment unit 16 comprises an exhaust aftertreatment device 18 for purifying exhaust gas of the engine 12, and a support mechanism 19 for supporting the exhaust aftertreatment device 18 at a position on the holding mechanism 17. A part (right portion) of the exhaust aftertreatment device 18 and the support mechanism 19 is provided at a position overlapping the hydraulic pump 15.

Figure 3:
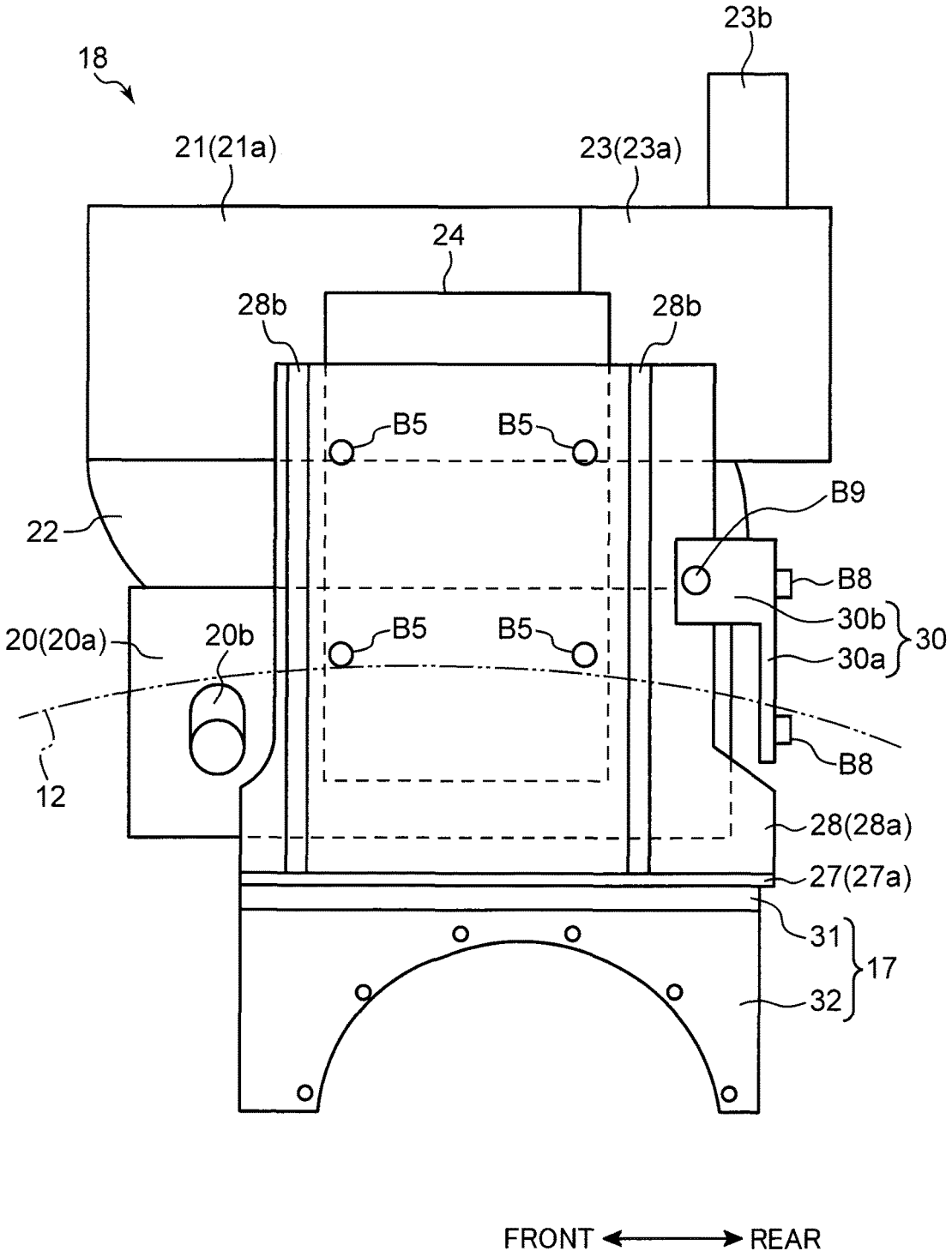
FIG. 3 is a left side view illustrating a substantial part of an aftertreatment unit in FIG. 2.
Figure 4:
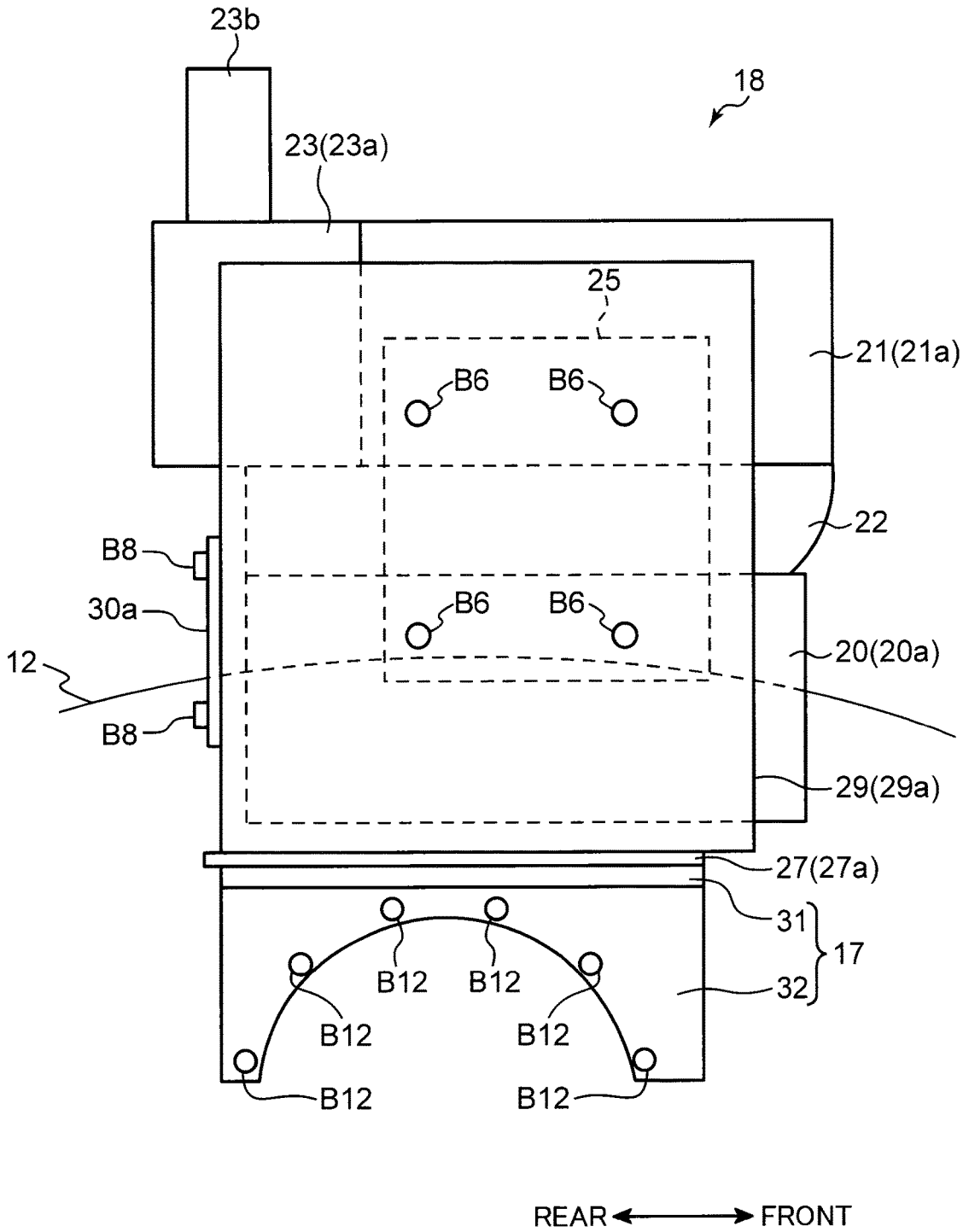
FIG. 4 is a right side view illustrating a substantial part of the aftertreatment unit in FIG. 2.
Figure 5:
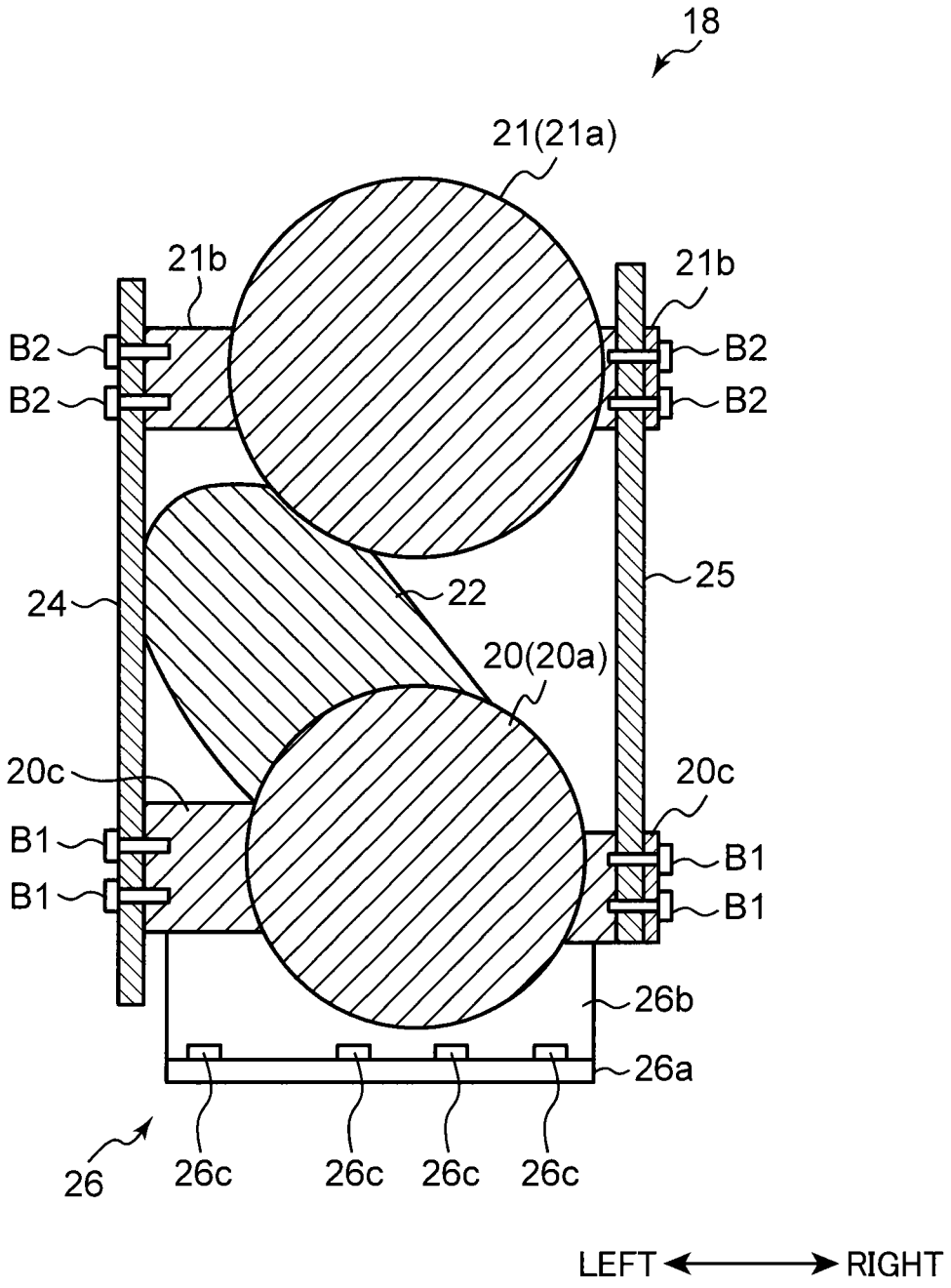
FIG. 5 is a schematic diagram illustrating a substantial part of an exhaust aftertreatment device in FIG. 2.

Referring to FIGS. 2 to 5, the exhaust aftertreatment device 18 comprises: a first treatment section 20 capable of removing a first component contained in the exhaust gas; a second treatment section 21 capable of removing a second component contained in the exhaust gas; a connection section 22 connecting the first treatment section 20 and the second treatment section 21 together; a muffler (silencer) 23; a right attaching plate 25 and a left attaching plate (attaching member) 24 each attached to the first and second treatment sections 20, 21; and a bracket 26 attached to a lower portion of the first treatment section 20. In FIG. 5, the exhaust aftertreatment device 18 is partly illustrated in cross-section to clarify an attached state between the first and second treatment sections 20, 21 and the two attaching plates 24, 25.

The first treatment section 20 is capable of removing unburned gas (one example of the first component, such as hydrocarbon, carbon monoxide, or nitrogen oxides) contained in the exhaust gas by means of oxidation. The first treatment section 20 in this embodiment has an oxidation catalyst (Diesel Oxidation Catalyst: hereinafter referred to as "DOC") having a function of oxidizing and removing unburned gas contained in the exhaust gas. In place of or in addition to the DOC, the first treatment section 20 may have a filter for trapping particulate matter (one example of the first component: hereinafter referred to as "PM") contained in the exhaust gas.

More specifically, the first treatment section 20 comprises: a first section body 20*a* comprised of the DOC and a housing containing therein the DOC; an introduction pipe 20*b* (see FIG. 3) provided at a front end of the first section body 20*a* to introduce the exhaust gas into the first section body 20*a* therethrough.

The second treatment section 21 is capable of removing nitrogen oxides (one example of the second component: hereinafter referred to as "NOx") by means of a selective catalytic reduction (hereinafter referred to as "SCR") reaction. Specifically, the second treatment section 21 comprises a second section body 21*a* comprised of a catalyst capable of promoting the SCR reaction of NOx, and a housing containing therein this catalyst.

The connection section 22 is a tubular portion connecting a non-illustrated outlet provided at a rear end portion of the first section body 20*a* and a non-illustrated inlet provided at a front end portion of the second section body 21*a* together.

The muffler 23 comprises a muffler body 23*a* connected to a non-illustrated outlet provided at a rear end portion of the second section body 21*a*, and a tail-pipe 23*b* extending upwardly from the muffler body 23*a*.

As illustrated in FIG. 3, exhaust gas discharged from the engine 12 is introduced into the first section body 20*a* via the introduction pipe 20*b*, and, after flowing through the first section body 20*a* in a direction from the front end to the rear end thereof, introduced into a rear portion of the connection section 22. Then, after flowing through the connection section 22 in a direction from the rear end to a front end thereof, the exhaust gas is introduced into the second section body 21*a*, and, after flowing through the second section body 21*a* in a direction from the front end to the rear end thereof, introduced into the muffler body 23*a*, whereafter the exhaust gas is discharged above the upper slewing body 3 via the tail-pipe 23*b*.

The first treatment section 20 and the second treatment section 21 are arranged in one-above-the-other and side-by-side relation. Specifically, in this embodiment, the entire second treatment section 21 is disposed above the first treatment section 20 in such a manner as to allow the second section body 21*a* to overlap the first section body 20*a*, in a posture where respective exhaust gas flow directions inside the first and second section bodies 20*a*, 21*a* become oriented opposite to and parallel to each other.

Referring to FIG. 5, each of the left attaching plate 24 and the right attaching plate 25 is attached to the first section body 20*a* and the second section body 21*a*, so that the first and second section bodies 20*a*, 21*a* are coupled together.

Specifically, the left attaching plate 24 is attached to an attached portion 20*c* protruding leftwardly from the first section body 20*a* by a bolt B1, and further attached to an attached portion 21*b* protruding leftwardly from the second section body 21*a* by a bolt B2.

The right attaching plate 25 is attached to an attached portion 20*c* protruding rightwardly from the first section body 20*a* by a bolt B1, and further attached to an attached portion 21*b* protruding rightwardly from the second section body 21*a* by a bolt B2.

The bracket 26 comprises: an attached portion 26*a* attached to the support mechanism 19 described in detail later; a connection portion 26*b* formed to extend upwardly from the attached portion 26*a* and connected to the first treatment section 20; and a plurality of fixed nuts 26*c* each fixed to an upper surface of the attached portion 26*a*. As illustrated in FIG. 6, the attached portion 26*a* is formed with a plurality of through-holes (their reference sign is omitted) in concentric relation with corresponding ones of the fixed nuts 26*c*.

Figure 8:
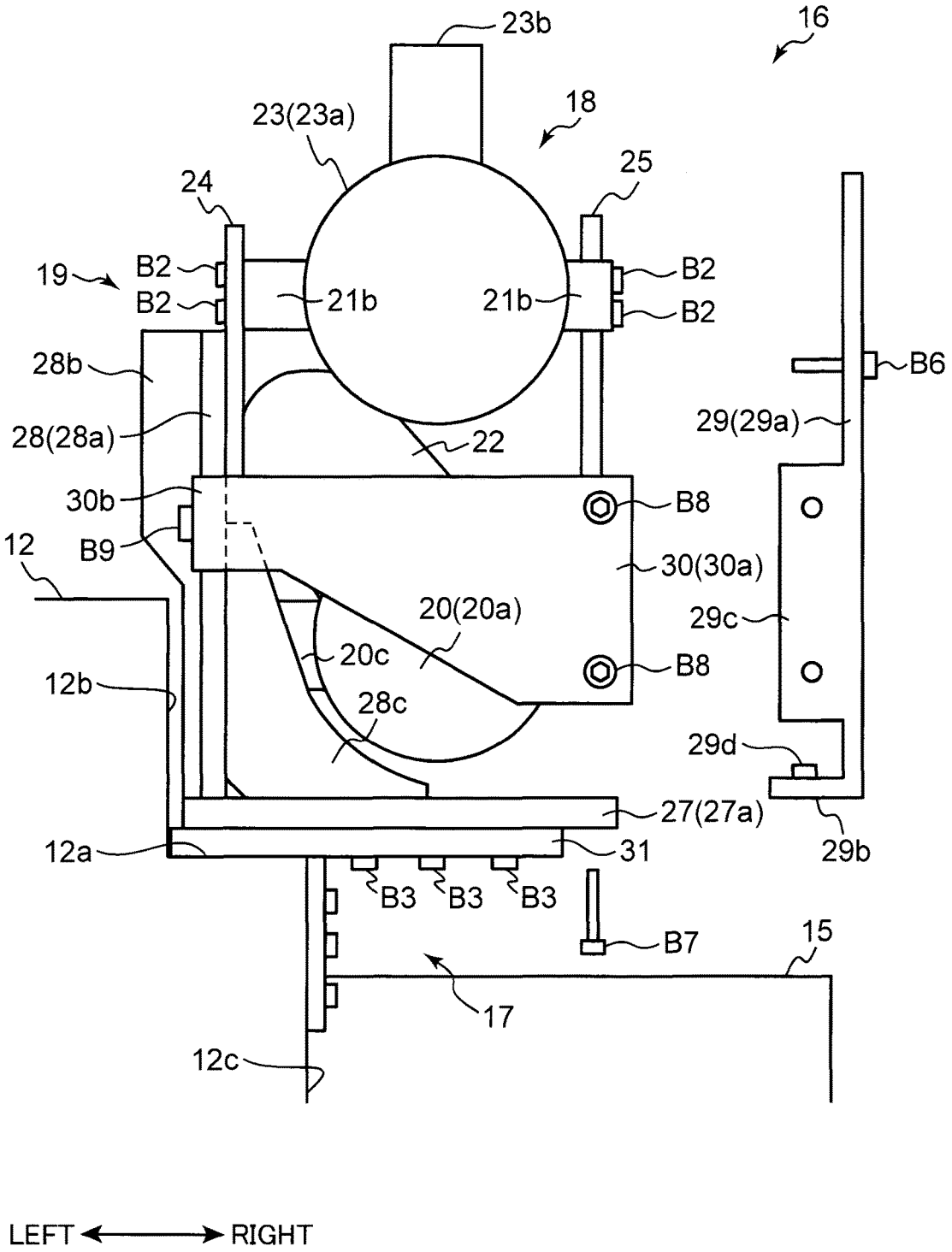
FIG. 8 is a schematic diagram illustrating the aftertreatment unit in FIG. 2, in a state in which a right vertical plate is detached therefrom.

With reference to FIGS. 6 to 8, the support mechanism 19 provided on the holding mechanism 17 to support the exhaust aftertreatment device 18 will be described below. In FIG. 6, the holding mechanism 17 is partly illustrated in cross-section to clarify a coupled state between the exhaust aftertreatment device 18 and the holding mechanism 17. In FIG. 7, the support mechanism 19 and the holding mechanism 17 are partly illustrated in cross-section to clarify a coupled state between the support mechanism 19 and the holding mechanism 17. FIG. 8 illustrates a state after detaching an aftermentioned right vertical plate 29 of the support mechanism 19 from the exhaust aftertreatment device 18.

The support mechanism 19 comprises: a lower plate (lower member) 27 attached to a lower surface of the attached portion 26*a* of the bracket 26; a left vertical plate (vertical member) 28 disposed to extend upwardly from a left end portion of the lower plate 27 and attached to a left lateral surface of the exhaust aftertreatment device 18 (left lateral surface of the left attaching plate 24); a right vertical plate (cover) 29 disposed to extend upwardly from a right end portion of the lower plate 27 and attached to a right lateral surface of the exhaust aftertreatment device 18 (right lateral surface of the right attaching plate 25); and a coupling plate (coupling member: see FIG. 8) 30 attached to the left vertical member 28 and the right vertical member 29 to allow the left vertical member 28 and the right vertical member 29 to be coupled together.

As illustrated in FIG. 4, the lower member 27 is attached to the lower surface of the exhaust aftertreatment device 18, to support the exhaust aftertreatment device 18 from therebeneath in such a manner that the exhaust aftertreatment device 18 is disposed at a position overlapping the engine 12 in side view.

Specifically, as illustrated in FIG. 6, the lower plate 27 has a lower plate body 27*a* disposed along the lower surface of the attached portion 26*a* of the bracket 26. The lower plate body 27*a* is provided with a plurality of through-holes (their reference sign is omitted). A plurality of bolts B4 penetratedly inserted, respectively, into the through-holes of the lower plate body 27*a* from therebeneath are threadingly engaged with corresponding ones of the fixed nuts 26*c* through corresponding ones of the through-holes of the attached portion 26*a*, so that the lower plate body 27*a* is fixed to the attached portion 26*a*. The loading plate portion 31 has a plurality of counterbores 31*b* each formed to allow a head of a respective one of the bolts B4 to be inserted thereinto, so that it becomes possible to load the lower plate body 27*a* onto the loading plate portion 31 while preventing the heads of the bolts B4 from coming into contact with the loading plate portion 31.

As illustrated in FIG. 7, the lower plate 27 further comprises a plurality of fixed nuts 27*b* fixed on the lower plate body 27*a*. The lower plate body 27*a* is formed with a plurality of through-holes (their reference sign is omitted) in concentric relation with corresponding ones of the fixed nuts 27*b*. A plurality of bolts B3 penetratedly inserted, respectively, into a plurality of through-holes of the loading body 31 from therebeneath are threadingly engaged with corresponding ones of the fixed nuts 27*b* through corresponding ones of the through-holes of the lower plate body 27*a*, so that the lower plate body 27*a* is fixed to the loading plate portion 31.

The left vertical plate 28 is disposed to extend upwardly from a portion of the lower plate 27 (lower plate body 27*a*) located between the exhaust aftertreatment device 18 and the engine 12, and attached to the left lateral surface of the exhaust aftertreatment device 18 (left lateral surface of the left attaching plate 24).

Specifically, as illustrated in FIG. 8, the left vertical plate 28 comprised a vertical plate body (vertical member body) 28*a* standingly provided on the lower plate body 27*a*, and a first rib 28*c* and a second rib 28*b* each provided on the vertical plate body 28*a*. A lower end portion of the vertical plate body 28*a* is welded to an upper surface of a left end portion of the lower plate body 27*a*.

As illustrated in FIG. 3, the vertical plate body 28*a* has an overlapping portion (its reference sign is omitted) overlapping the engine 12 in side view, and an outside portion (its reference sign is omitted) located outside (above) the engine 12 in side view. As illustrated in FIG. 8, the first rib 28*c* extends from the overlapping portion toward a side opposite to the engine 12 (rightwardly), and the second rib 28*b* extends from the outside portion toward the engine (leftwardly). This makes it possible to enhance rigidly of the left vertical plate 28 (vertical plate body 28*a*) in the lateral direction while allowing the left vertical plate 28 to come close to the engine 12. A lower end portion of the first rib 28*c* is welded to an upper surface of the lower plate body 27*a*. As illustrated in FIG. 3, the second rib 28*b* is provided in a number of two, wherein the two second ribs 28*b* are disposed, respectively, at front and rear end portions of the left vertical plate 28. Although illustration is omitted, the first rib 28*c* is also provided in a number of two, wherein the two first ribs 28*c* are disposed, respectively, at the same positions as those of the second ribs 28*b* of the left vertical plate 28 in a front-rear direction.

As illustrated in FIG. 6, the vertical plate body 28*a* is fixed to the left attaching plate 24 by penetratingly inserting a bolt B5 into a through-hole (its reference sign is omitted) formed in the vertical plate body 28*a*, from a left side of the vertical plate body 28*a*, and then threadingly engaging the bolt B5 with an internally threaded portion (its reference sign is omitted) formed in the left attaching plate 24. As illustrated in FIG. 3, the vertical plate body 28*a* is fixed to the left attaching plate 24 by four bolts B5. In this way, the exhaust aftertreatment device 18 is supported by the left vertical plate 28 from a left side thereof.

On the other hand, as illustrated in FIG. 6, the right vertical plate 29 comprises: a vertical plate body 29*a* covering a part of the exhaust aftertreatment device 18 from a side opposite to the left vertical plate 28 with respect to the exhaust aftertreatment device 18 (from a right side thereof); an attached portion 29*b* extending leftwardly from a lower end portion of the vertical plate body 29*a*; and a fixed nut 29*d* fixed on the attached portion 29*b*.

The vertical plate body 29*a* is fixed to the right attaching plate 25 by penetratingly inserting a bolt B6 into a through-hole (its reference sign is omitted) formed in the vertical plate body 29*a*, from a right side of the vertical plate body 29*a*, and then threadingly engaging the bolt B6 with an internally threaded portion (its reference sign is omitted) formed in the right attaching plate 25. As illustrated in FIG. 4, the vertical plate body 29*a* is formed to have a size covering a large part of the exhaust aftertreatment device 18 (particularly, the first treatment section 20), and fixed to the right attaching plate 25 by four bolts B6. As illustrated in FIG. 6, the attached portion 29*b* is formed with a through-hole (its reference sign is omitted) in concentric relation with the fixed nut 29*d*. The attached portion 29*b* is fixed to the lower plate 27 by penetratingly inserting a bolt B7 into a through-hole (its reference sign is omitted) formed in the lower plate 27, from therebeneath, and then threadingly engaging the bolt B7 with the fixed nut 29*d* via the through-hole of the attached portion 29*b*. Through the above bolts B6, B7, the right vertical plate 29 is detachably attached to the lateral surface (right lateral surface) of the exhaust aftertreatment device 18, and the lower plate 27.

As illustrated in FIG. 8, the right vertical plate 29 further comprises a coupling plate mounting portion 29*c* extending leftwardly from a rear end portion of the vertical plate body 29*a*.

The coupling plate 30 comprises a coupling plate body 30*a* covering a part of the exhaust aftertreatment device 18 (part of the first treatment section 20) from a rear side thereof, and a attached portion 30*b* extending frontwardly from a left end portion of the coupling plate body 30*a*.

The coupling plate body 30*a* has a right end portion formed with a non-illustrated through-hole. The coupling plate 30 is detachably attached to the right vertical plate 29 by penetratingly inserting a bolt B8 into the through-hole of the coupling plate body 30*a*, from a rear side of the coupling plate body 30*a*, and then threadingly engaging the bolt B8 with an internally threaded portion (its reference sign is omitted) formed in the coupling plate mounting portion 29*c* of the right vertical plate 29.

The attached portion 30*b* is formed with a non-illustrated through-hole. The coupling plate 30 is detachably attached to the left vertical plate 28 by penetratingly inserting a bolt B9 into the through-hole of the attached portion 30*b*, from a left side of the attached portion 30*b*, and then threadingly engaging the bolt B9 with a non-illustrated internally threaded portion formed in the vertical plate body 28*a* of the left vertical plate 28.

As illustrated in FIG. 8, the right vertical plate 29 is detached from the exhaust aftertreatment device 18 by: unfastening the bolt B7 from the fixed nut 29*d*; unfastening the bolt B8 from the right vertical plate 29; and unfastening the bolt B6 from the right attaching plate 25. Instead of the bolt B8, the bolt B9 may be unfastened from the left vertical plate 28. In this case, a set of the right vertical plate 29 and the coupling plate 30 can be detached from the exhaust aftertreatment device 18. After detaching the right vertical plate 29 or a set of the right vertical plate 29 and the coupling plate 30 from the exhaust aftertreatment device 18 in the above manner, the exhaust aftertreatment device 18 can be subjected to maintenance from a right side or right and rear sides thereof.

As described above, the exhaust aftertreatment device 18 can be supported by the lower plate (lower member) 27 and the left vertical plate (vertical member) 28 from therebeneath and from the left side thereof, so that it becomes possible to suppress lateral vibration of the exhaust aftertreatment device 18 to stably support the exhaust aftertreatment device 18, as compared to the case where the exhaust aftertreatment device 18 is supported only by the lower plate from therebeneath.

Furthermore, the left vertical plate 28 is provided at a position between the engine 12 and the exhaust aftertreatment device 18 which are arranged in overlapping relation in side view, i.e., on the side of the engine 12 (left side) where access to the exhaust aftertreatment device 18 is originally restricted. Thus, access to the exhaust aftertreatment device 18 is permitted from any side of the exhaust aftertreatment device 18 where the left vertical plate 28 does not exist (e.g., a side opposite to the engine (right side).

This makes it possible to maintain maintainability of the exhaust aftertreatment device 18 while stably supporting the exhaust aftertreatment device 18.

The hydraulic excavator according to the first embodiment can bring out the following advantageous effect.

The left vertical plate body (vertical member body) 28*a* is provided with the first rib 28*c* and the second rib 28*b*, so that rigidity of the vertical plate body 28*a* in a direction coming closer to the engine 12 and a direction coming away from the engine 12 (in a left-right direction) is enhanced.

Furthermore, the overlapping portion of the vertical plate body 28*a* overlapping the engine 12 in side view is provided with the first rib 28*c* extending toward the side opposite to the engine 12 (rightwardly), as illustrated in FIG. 8, so that the overlapping portion can be disposed adjacent to the engine 12, irrespective of a height of the first rib 28*c*.

Thus, it becomes possible to satisfy both of stable support of the exhaust aftertreatment device 18 and downsizing of the hydraulic excavator 1.

The right vertical plate (cover) 29 makes it possible to reduce a possibility of contact between fuel or hydraulic oil and the exhaust aftertreatment device 18 in the event of breakage of a fuel line or a hydraulic line. Thus, it becomes possible to suppress the occurrence of fire due to contact between the exhaust aftertreatment device 18 heated by exhaust gas, and fuel or hydraulic oil. Particularly, the first treatment section 20 can be configured to increase a temperature of exhaust gas to facilitate burning of trapped PM. In this case, the first treatment section 20 has a higher temperature than that in a normal operation. Thus, the technique of covering the first treatment section 20 by the right vertical plate 29 becomes effective.

Furthermore, the right vertical plate 29 is detachable with respect to the lower plate 27, so that it becomes possible to maintain maintainability of the exhaust aftertreatment device 18.

The right vertical plate 29 is additionally usable as a support member for supporting the exhaust aftertreatment device 18 from a lateral side thereof, so that it becomes possible to more stably support the exhaust aftertreatment device 18.

The left vertical plate 28 and the right vertical plate 29 can be integrated by the coupling plate 30 to thereby more reliably support the exhaust aftertreatment device 18 from opposite lateral sides thereof.

The first treatment section 20 and the second treatment section 21 can be attached to the vertical plates 28, 29 in such a manner that the treatment sections 20, 22 are preliminarily integrated together by the attaching plates 24, 25, and, in this state, the attaching plates 24, 25 are attached to the vertical plates 28, 29. This provides enhanced assemblability of the exhaust aftertreatment device 18.

Second Embodiment

In the first embodiment, the lower plate 27 is provided on the engine 12. However, the lower plate 27 may be provided above the slewing frame 11 to support the exhaust aftertreatment device 18 from therebeneath in such a manner that the exhaust aftertreatment device 18 is disposed at a position overlapping the engine in side view.

Figure 9:
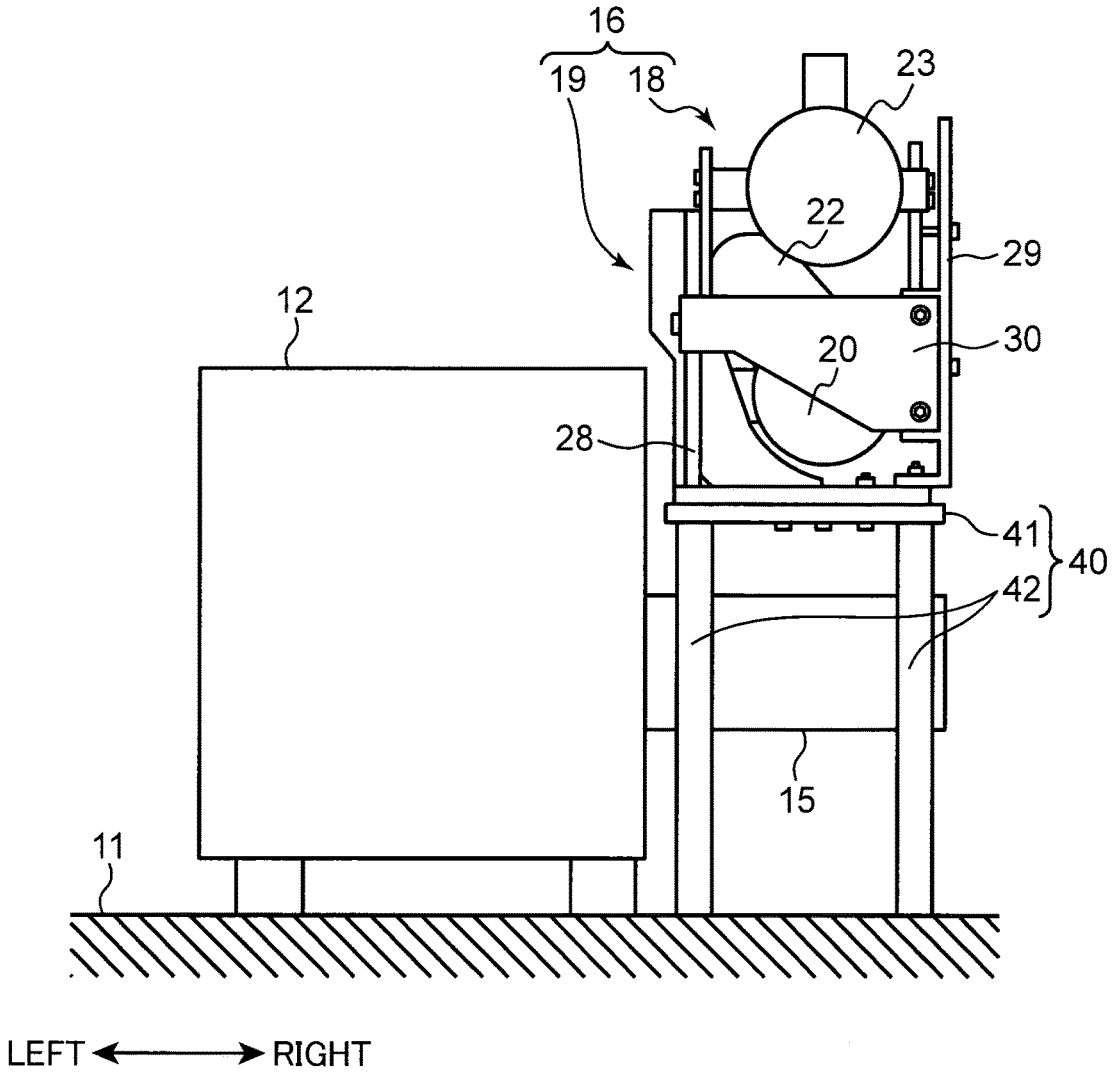
FIG. 9 is a view comparable to FIG. 2, illustrating a hydraulic excavator according to a second embodiment of the present invention.

For example, the lower plate 27 in a hydraulic excavator according to a second embodiment of the present invention illustrated in FIG. 9 is provided on a holding mechanism 40 provided on the slewing frame 11.

The holding mechanism 40 comprises a loading plate portion 41, and four legs 42 (in FIG. 9, only two of them are illustrated) provided on the slewing frame 11 to support the loading plate portion 41.

The lower plate 27 is loaded onto the loading plate portion 41, and fixed to the loading plate portion 41.

Two of the legs 42 are provided in front of the hydraulic pump 15, and the remaining two legs 42 are provided behind the hydraulic pump 15. The loading plate portion 41 is fixed to upper ends of the four legs 42, so that the loading plate portion 41 is disposed at a position overlapping the hydraulic pump 15 in top plan view.

In the second embodiment, it is possible to maintain maintainability of the exhaust aftertreatment device 18 while stably supporting the exhaust aftertreatment device 18.

It should be understood that the present invention is not limited to the above embodiments. For example, the following modifications may be employed.

In the above embodiments, the engine 12 is disposed on the slewing frame in a posture where the output shaft of the engine 12 is oriented in the lateral direction. However, the direction of the engine 12 is not particularly limited. For example, the engine 12 may be disposed in a posture where the output shaft of the engine 12 is oriented in the front-rear direction.

Although the above embodiments have been described based on an example where the exhaust aftertreatment device 18 is disposed at a position overlapping the engine 12 when viewed rightwardly and leftwardly, the position of the exhaust aftertreatment device 18 is not limited thereto. That is, the exhaust aftertreatment device 18 may be disposed at a position overlapping the engine 12 when viewed from a lateral side of the engine 12 (when viewed horizontally from any position surrounding the engine 12).

Although the above embodiments have been described based on an example where the right vertical plate 29 covers a part of the exhaust aftertreatment device 18, the right vertical plate 29 may cover an entirety of the exhaust aftertreatment device 18.

In the above embodiments, the coupling plate 30 is attached to the right vertical plate 29 and the left vertical plate 28. Alternatively, the coupling plate 30 may be attached to the lower plate 27.

Alternatively, in place of the coupling plate 30, it is possible to provide a coupling plate attached to the right vertical plate 29 and the lower plate 27 in such a manner as to couple the right vertical plate 29 and the lower plate 27 together.

Further, a cover covering the exhaust aftertreatment device 18 from a front side thereof may be provided, wherein this cover, the coupling plate 30 and the right vertical plate 29 may be integrally formed.

In the above embodiments, the right vertical plate 29 and the coupling plate 30 are fixed to each other by the bolt B8. Alternatively, the right vertical plate 29 and the coupling plate 30 may be formed as a single member by press working or the like.

In the above embodiments, each of the left attaching plate 24, the right attaching plate 25, the lower plate 27, the left vertical plate 28, the right vertical plate 29 and the coupling plate 30 is composed of a plate-shaped member. However, each of the above members is not limited to being composed of a plate-shaped member.

In the above embodiments, the second treatment section 21 is disposed above the first treatment section 20. However, the treatment sections 20, 21 may be disposed in one-above-the-other and side-by-side relation. Specifically, a part of one of the treatment sections 20, 21 overlaps a part of the other. For example, the second treatment section 21 may be disposed beneath the first treatment section 20. Further, the present invention is not limited to an arrangement in which an entirety of one of the treatment sections 20, 21 is disposed above the other. For example, the first treatment section 20 and the second treatment section 21 may be obliquely arranged in such a manner that the first treatment section 20 and the second treatment section 21 partly overlap each other in side view.

The construction machine of the present invention is not limited to the hydraulic excavator, may be a crane or a demolishing machine, and may be a hybrid type instead of a hydraulic type.

The above specific embodiments mainly include an invention having the following features.

In order to solve the aforementioned problem, the inventors of this application have conceived an inventive idea of supporting an exhaust aftertreatment device from therebeneath and a lateral side thereof by a lower member attached to a lower surface of the exhaust aftertreatment device and a vertical member extending upwardly from the lower member.

However, for maintenance of the exhaust aftertreatment device, it is necessary to access each of the first and second treatment sections from a lateral side thereof. Thus, depending on the arrangement of the vertical member, there is a problem of causing deterioration in maintainability of the exhaust aftertreatment device.

Therefore, the present invention provides a construction machine capable of maintaining maintainability of the exhaust aftertreatment device while stably supporting an exhaust aftertreatment device.

Specifically, the present invention provides a construction machine which comprises: a frame; an engine provided on the frame; an exhaust aftertreatment device for purifying exhaust gas of the engine, wherein the exhaust aftertreatment device comprises a first treatment section capable of removing a first component contained in the exhaust gas, and a second treatment section capable of removing a second component contained in the exhaust gas, wherein the second treatment section is disposed above or below the first treatment section in side-by-side relation; a lower member attached to a lower surface of the exhaust aftertreatment device, and provided above the frame to support the exhaust aftertreatment device from therebeneath in such a manner that the exhaust aftertreatment device is disposed at a position overlapping the engine in side view; and a vertical member disposed to extend upwardly from a portion of the lower member located between the exhaust aftertreatment device and the engine, and attached to a lateral surface of the exhaust aftertreatment device.

In the construction machine of the present invention, the exhaust aftertreatment device can be supported by the lower member and the vertical member from therebeneath and from a lateral side thereof, so that it becomes possible to suppress lateral vibration of the exhaust aftertreatment device to stably support the exhaust aftertreatment device, as compared to the case where the exhaust aftertreatment device is supported only by the lower member from therebeneath.

In this case, the vertical member is provided at a position between the engine and the exhaust aftertreatment device which are arranged in overlapping relation in side view, i.e., on the side of the engine where access to the exhaust aftertreatment device is originally restricted. Thus, access to the exhaust aftertreatment device is permitted from any side of the exhaust aftertreatment device where the vertical member does not exist (e.g., a side opposite to the engine).

Thus, the present invention makes it possible to maintain maintainability of the exhaust aftertreatment device while stably supporting the exhaust aftertreatment device.

As used in this specification, the term "disposed above or below" means a state in which a part of one of the first treatment section and the second treatment section overlaps a part of the other in top plan view, and includes not only a state in which an entirety of one of the first treatment section and the second treatment section is disposed above the other but also a state in which the first treatment section and the second treatment section partly overlap each other in side view (a state in which the first treatment section and the second treatment section are obliquely arranged).

A rib extending from the vertical member toward the engine may be provided to increase rigidity of the vertical member in a direction coming closer to or away from the engine 12. In this case, however, it is necessary to move the vertical member away from the engine by a distance corresponding to a height of the rib.

Therefore, preferably, in the above construction machine, the vertical member comprises: a vertical member body having an overlapping portion overlapping the engine in side view, and an outside portion located outside the engine in side view; a first rib extending from the overlapping portion toward a side opposite to the engine; and a second rib extending from the outside portion toward the engine.

In this aspect, the vertical member body is provided with the first rib and the second rib, so that rigidity of the vertical member body in a direction coming closer to the engine and a direction coming away from the engine is enhanced.

In this aspect, the overlapping portion of the vertical member body overlapping the engine in side view is provided with the first rib extending toward the side opposite to the engine, so that the overlapping portion can be disposed adjacent to the engine, irrespective of a height of the first rib.

Thus, it becomes possible to satisfy both of stable support of the exhaust aftertreatment device and downsizing of the construction machine.

The maintainability of the exhaust aftertreatment device is enhanced by opening the exhaust aftertreatment device on a side other than the side of the vertical member. However, a fuel line and a hydraulic line are provided around the engine, and, if such a line is broken, there is a risk of the occurrence of fire due to contact between the exhaust aftertreatment device heated by exhaust gas, and fuel or hydraulic oil.

Therefore, preferably, the construction machine further comprises a cover covering at least a part of the exhaust aftertreatment device from on a side opposite to the vertical member with respect to the exhaust aftertreatment device, wherein the cover is detachably attached to the lower member.

In this aspect, the cover makes it possible to reduce a possibility of contact between fuel or hydraulic oil and the exhaust aftertreatment device in the event of breakage of a fuel or hydraulic line.

The cover is detachable with respect to the lower member, so that it becomes possible to maintain maintainability of the exhaust aftertreatment device.

In this aspect, while the cover may be provided only for the purpose of suppressing the contact between fuel or hydraulic oil and the exhaust aftertreatment device, it is more preferable that the cover is detachably attached to a lateral surface of the exhaust aftertreatment device on the side opposite to the vertical member.

In this aspect, the cover is additionally usable as a support member for supporting the exhaust aftertreatment device from a lateral side thereof, so that it becomes possible to more stably support the exhaust aftertreatment device.

The above construction machine may further comprise a coupling member attached to the vertical member and the cover to allow the vertical member and the cover to be coupled together.

In this aspect, the vertical member and the cover can be integrated by the coupling member to thereby more reliably support the exhaust aftertreatment device from opposite lateral sides thereof.

In the present invention, the first treatment section and the second treatment section may be attached to the vertical member, individually. In this case, however, it is necessary to provide an operation for attaching the first treatment section and the second treatment section to the vertical member, individually, thereby causing deterioration in assemblability.

Therefore, in the above construction machine, the exhaust aftertreatment device further comprises an attaching member attached to the first treatment section and the second treatment section, wherein the attaching member is attached to the vertical member.

In this aspect, the first treatment section and the second treatment section can be attached to the vertical member in such a manner that the treatment sections are preliminarily integrated together by the attaching member, and, in this state, the attaching member is attached to the vertical member. This provides enhanced assemblability of the exhaust aftertreatment device.

This application is based on Japanese Patent application No. 2014-232991 filed in Japan Patent Office on Nov. 17, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A construction machine comprising:

a frame;

an engine provided on the frame;

an exhaust aftertreatment device for purifying exhaust gas of the engine, the exhaust aftertreatment device comprising a first treatment section capable of removing a first component contained in the exhaust gas, and a second treatment section capable of removing a second component contained in the exhaust gas, the second treatment section being disposed above or below the first treatment section in side-by-side relation;

a lower member attached to a lower surface of the exhaust aftertreatment device, and provided above the frame to support the exhaust aftertreatment device from therebeneath in such a manner that the exhaust aftertreatment device is disposed at a position overlapping the engine in side view; and a vertical member disposed to extend upwardly from a portion of the lower member located between the exhaust aftertreatment device and the engine, and attached to a lateral surface of the exhaust aftertreatment device.

2. The construction machine according to claim 1, wherein the vertical member comprises:

a vertical member body having an overlapping portion overlapping the engine in the side view, and an outside portion located outside the engine in the side view;

a first rib extending from the overlapping portion toward a side opposite to the engine; and a second rib extending from the outside portion toward the engine.

3. The construction machine according to claim 1, which further comprises a cover covering at least a part of the exhaust aftertreatment device from on a side opposite to the vertical member with respect to the exhaust aftertreatment device, the cover being detachably attached to the lower member.

4. The construction machine according to claim 3, wherein the cover is detachably attached to a lateral surface of the exhaust aftertreatment device on the side opposite to the vertical member.

5. The construction machine according to claim 4, which further comprises a coupling member attached to the vertical member and the cover to allow the vertical member and the cover to be coupled together.

6. The construction machine according to claim 1, wherein the exhaust aftertreatment device further comprises an attaching member attached to the first treatment section and the second treatment section, the attaching member being attached to the vertical member.

7. The construction machine according to claim 1, wherein the vertical member comprises a lower end portion fixed to the lower member and a portion extending upwardly from the lower end portion so as to pass through a space between the exhaust aftertreatment device and the engine and attached to the lateral surface of the exhaust aftertreatment device.

8. The construction machine according to claim 7, wherein the lower member directly attached to the lower surface of the exhaust aftertreatment device.

9. The construction machine according to claim 1, wherein the lower member directly attached to the lower surface of the exhaust aftertreatment device.

* * * * *